US008590882B2

(12) United States Patent
Furuyama et al.

(10) Patent No.: US 8,590,882 B2
(45) Date of Patent: Nov. 26, 2013

(54) FEEDER UNIT

(75) Inventors: Masafumi Furuyama, Shiojiri (JP); Toshio Miyake, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 173 days.

(21) Appl. No.: 12/751,738

(22) Filed: Mar. 31, 2010

(65) Prior Publication Data

US 2010/0252987 A1 Oct. 7, 2010

(30) Foreign Application Priority Data

Apr. 1, 2009 (JP) ..... 2009-089259

(51) Int. Cl.
*B65H 5/22* (2006.01)
*B65H 83/00* (2006.01)
*B65H 85/00* (2006.01)

(52) U.S. Cl.
USPC ..... 271/3.14; 271/145; 271/162; 271/207; 271/213; 271/214

(58) Field of Classification Search
USPC ..... 271/3.14, 145, 162, 207, 213, 214, 163
See application file for complete search history.

(56) References Cited

U.S. PATENT DOCUMENTS 5,284,337 A * 2/1994 Ettischer et al. ..... 271/220
6,382,617 B1 * 5/2002 Yen et al. ..... 271/3.14
6,612,561 B2 * 9/2003 Sekine ..... 271/3.14
6,848,685 B2 * 2/2005 Katsuyama ..... 271/162
7,398,971 B2 * 7/2008 Horiba ..... 271/162
7,510,180 B2 * 3/2009 Jang et al. ..... 271/127
7,823,877 B2 * 11/2010 Yoshioka et al. ..... 271/162
2002/0056957 A1 * 5/2002 Sekine ..... 271/3.14
2006/0180994 A1 * 8/2006 Jang et al. ..... 271/126
2006/0261539 A1 * 11/2006 Terada ..... 271/162
2007/0001382 A1 * 1/2007 Matsumoto et al. ..... 271/162
2009/0146362 A1 * 6/2009 Yoshioka et al. ..... 271/3.14
2009/0218749 A1 * 9/2009 Shingai ..... 271/3.14
2009/0267283 A1 * 10/2009 Mizuguchi ..... 271/3.14

FOREIGN PATENT DOCUMENTS

JP 05-014593 1/1993
JP 2005-088219 4/2005
JP 2008-114937 5/2008

* cited by examiner

*Primary Examiner* — Prasad Gokhale
(74) *Attorney, Agent, or Firm* — Workman Nydegger

(57) ABSTRACT

A feeder unit includes: a first tray that keeps a storage position in which the first tray is stored within the base portion and an operation position, and is provided at one end of a feeding path of a medium so as to place the medium thereon; a cover member that is openably and closeably provided to cover the first tray in the storage position when being closed or uncover the first tray when being open; and a first power transmitter that transmits power to open and close the cover member to the first tray, and the first power transmitter is configured so as to displace the first tray to the operation position with the displacement of the cover member when the cover member is switched to an open-state, and to the storage position with the displacement of the cover member when the cover member is switched to a closed-state.

4 Claims, 6 Drawing Sheets

FEEDER UNIT

BACKGROUND

1. Technical Field

The present invention relates to a feeder unit including a tray which is provided on one end side of a feeding path of a medium to be fed (hereinafter called a medium) and is used to place the medium thereon, a base portion which forms a housing which accommodates the tray, and a cover portion which is openably and closeably provided and covers the tray when being closed.

2. Related Art

JP-A-5-14593 discloses a document reader with a feeder unit which feeds a paper sheet which is an example of a medium. The feeder unit includes a cover member, a paper supply tray, a paper discharge tray and a document feeder. The cover member is provided so as to be able to cover the paper supply tray. Accordingly, a user can open the cover member to set a bundle of paper sheets in the paper supply tray. Subsequently, the feeder unit can feed a paper sheet.

However, the paper supply tray and the paper discharge tray are at all times fixed to the housing of the feeder unit body. Therefore there is provided between the paper supply tray and the cover member a sufficient gap so that the paper supply tray does not interfere with, or abut the cover member when the cover member is closed.

Accordingly, the wider the gap created when the cover member is closed causes to be a larger loss in the interior space when the cover member is closed. Consequently, there may be a risk that the whole of the feeder unit becomes large in size.

SUMMARY

An advantage of some aspects of the invention is to provide a feeder unit which allows reduction in size of the whole feeder unit when the cover member being closed.

A feeder unit according to a first aspect of the invention includes a base portion forming a housing, a first tray which keeps a storage position in which the first tray is stored within the base portion, and an operation position that is displaced in a direction to which the first tray projects outside of the base portion from the storage position, and is provided at one end of the feeding path of a medium so as to place the medium thereon, a cover member which is openably and closeably provided so as to cover the first tray in the storage position when being closed and to uncover the first tray when being open, and a first power transmitter which transmits power to open and close the cover member to the first tray, the first power transmitter being configured so as to displace the first tray to the operation position with the displacement of the cover member when the cover member is switched to an open-state, and to the storage position with the displacement of the cover member when the cover member is switched to a closed-state.

According to the first aspect of the invention, it is possible to reduce a loss of space when the cover member is closed as compared to the configuration which does not allow the first tray to displace in accordance with the open or close operation of the cover member. The whole of the feeder unit with the cover member closed can consequently be reduced in size as compared to the configuration that does not allow the cover member to follow the operation.

In addition, the first tray is configured so as to be displaceable, a jammed medium can easily be removed by displacing the first tray when the medium is jammed in the feeding path due to some cause. In particular, this removal is effectively performed in the configuration in which the first tray is located on the upstream side in the feeding direction of the medium, and the medium being discharged below the first tray.

According to a second aspect of the invention, the feeder unit of the first aspect of the invention includes: a second tray which keeps an operation position in which the second tray forms a continuous surface with the feeding path and a non-operation position in which the second tray is spaced apart from the feeding path, and is provided at the other end of the feeding path to place the medium thereon; and a second power transmitter which transmits the power of the cover member to the second tray, the second power transmitter being configured so as to displace the second tray to the operation position with the displacement of the cover member when the cover member is switched to the open-state, and also to the non-operation position with the displacement of the cover member when the cover member is switched to the closed-state.

According to the second aspect of the invention, in addition to the same operational effect as that of the first embodiment, the second tray can also be operated in accordance with the opening or closing of the cover member as well as the first tray. Accordingly, the amount of a useless space can be reduced with the cover member being closed as compared to the configuration which does not allow the second tray to operate in accordance with the opening or closing of the cover member. As a result, the whole of the feeder unit with the cover member being closed can be reduced in size.

In addition, the second tray located in the non-operation position can play a role as a member other than a tray. For example, it is possible for the second tray to have a role as an external surface member which enhances the external appearance by forming a continuous surface with the cover member closed.

According to a third aspect of the invention, in the feeder unit in the first or second aspect, the first tray is provided with edge guides which are displaceable in the width direction of the medium to align the side edges of the medium, and the edge guides project outside of the base portion with the displacement of the first tray from the storage position to the operation position.

According to the third aspect of the invention, the edge guides project outside of the base portion with the first tray being in the operation position, in addition to the same operational effect as that of the first or second embodiment. Accordingly, a user is able to operate more easily the edge guides as compared to the configuration in which the edge guides do not project. This means that, in the third aspect, the feeder unit is excellent in the operability of the edge guides.

According to a fourth aspect of the invention, in the feeder unit in any one of the first to third aspects, the cover member is provided so as to be opened or closed by swinging itself. The one end side of the cover member located based on the swinging fulcrum of the cover member covers the first tray when the cover member is closed, and the other end side of the cover member pushes up to displace the first tray to the operation position when the cover member is swung to be open.

According to the fourth aspect of the invention, such a simple configuration allows the cover member to operate in accordance with the first tray in addition to the same operational effect as that of any one of the first to third aspects.

According to a fifth aspect of the invention, the feeder unit in any one of the first to fourth aspects of the invention, further includes the second tray which is provided at the other end of the feeding path to place the medium thereon. The feeding path is formed in a U-shape based on a vertical plate arrangement structure, in which the first tray places thereon the medium before being fed and the second tray places thereon the medium after being fed; the first tray, located above the second tray in the vertical plate arrangement direction, is displaced to the operation position from the storage position in the vertical plate arrangement direction when the cover member is switched to the open-state, whereby a gap in the thickness direction of the medium is increased in the feeding path located below the first tray in the vertical plate arrangement direction.

According to the fifth aspect of the invention, the operation of opening or closing the cover member can cause a change in a gap in the thickness direction of the medium in the feeding path located below the first tray in the vertical plate arrangement direction, in addition to the same operational effect as that of any one of the first to fourth aspects. Specifically, the gap can be reduced while the cover member being closed. The whole of the feeder unit with the cover member closed can whereby be reduced in size by the reduced amount of the gap. In particular, this reduction in size is effectively accomplished with a vertical plate arrangement structure, in which the first tray places thereon the medium before being fed and the second tray places thereon the medium after being fed, and the first tray is positioned above the second tray in the vertical plate arrangement direction, additionally, the feeding path is formed in a U-shape.

BRIEF DESCRIPTION OF THE DRAWINGS

The invention will be described with reference to the accompanied drawings, wherein like numbers reference like elements.

DESCRIPTION OF EXEMPLARY EMBODIMENTS

According to an aspect of the invention, a feeder unit and an image processing unit provided with the feeder unit will be described below.

Figure 1:
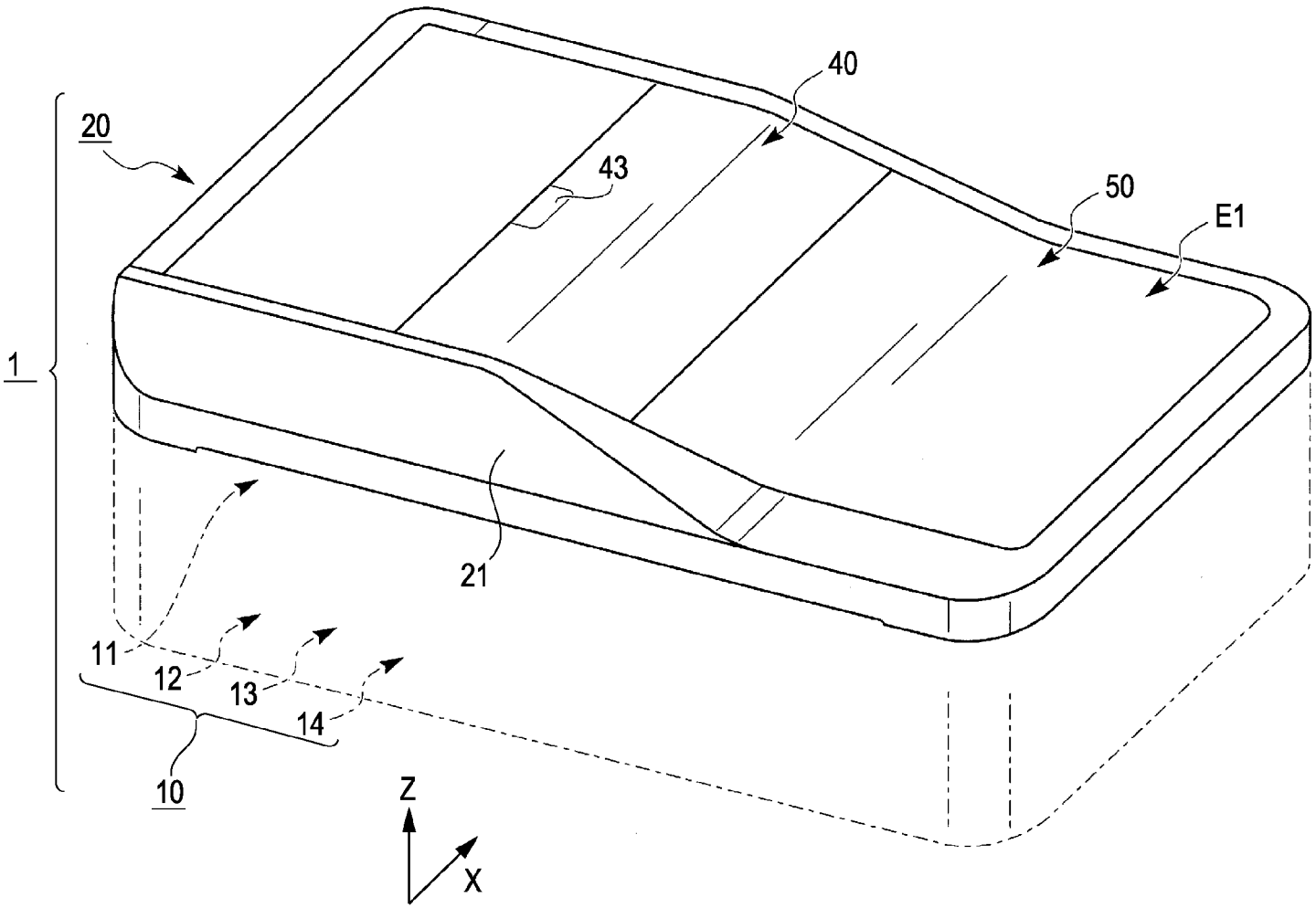
FIG. 1 is a perspective view showing a complex printer machine with a cover member closed according to the invention.
Figure 2:
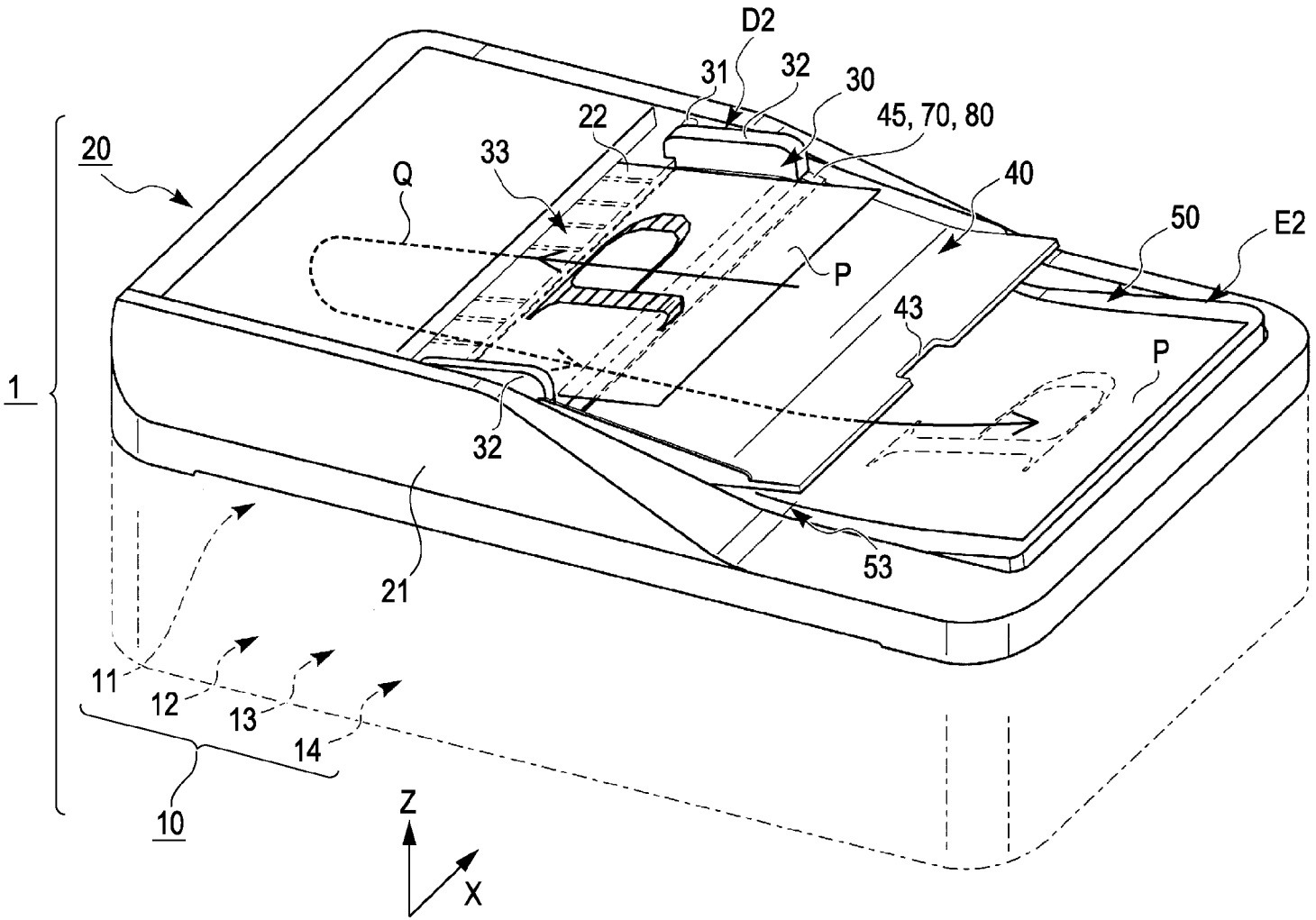
FIG. 2 is a perspective view showing the complex printer machine with the cover member opened according to the invention.

FIG. 1 is a perspective view showing an appearance of a complex printer machine, serving as an image processing unit, with a cover member closed. FIG. 2 is a perspective view showing an appearance of the complex printer machine with a cover member opened.

First, an overall schematic configuration of a complex printer machine mounting a scanner on the upper side of an ink jet printer will be described as a best mode in realizing an image processing unit of the invention.

As illustrated in FIGS. 1 and 2, a complex printer machine 1 includes a printer body 10 and a feeder unit 20.

The printer body 10 of these is disposed in the vertically lower portion of the complex printer machine 10 as illustrated in dashed lines. The printer body 10 includes a scanner 11, a feeder 12, a recorder 13 and a discharger 14.

The scanner 11 is disposed on the feeder unit side, i.e., on the upper portion of the printer body 10. The scanner 11 is configured so as to be able to read information in photographs and documents recorded on paper P fed by the feeder unit 20, later described in detail. The feeder 12 is configured so as to be able to feed the paper P stacked inside the printer body 10. Furthermore, the recorder 13 is configured so as to be able to execute recording operation by ejecting ink onto the paper P fed by the feeder 12. The discharger 14 is configured so as to be able to discharge the paper P, having been applied the recording operation by the recorder 13, from the inside of the printer body 10 to the outside.

The feeder unit 20 is disposed above the printer body 10, and provided so as to be able to feed the paper P to a position opposite to the scanner 11 placed on the printer body side. Then, the information recorded on the paper P is read by the scanner 11. Then, the feeder unit 20 feeds the paper P to a discharge tray 50 (see FIG. 2).

It is also possible to swing the whole feeder unit upward to set the paper P directly to the position opposite to the scanner 11, where the face of the paper P to be read faces the scanner 11 in the printer body 10. In this case, the feeder unit once swung upward is swung downward to press the paper P against the scanner 11, whereby the information recorded on the paper P can be read by the scanner 11.

The feeder unit 20 includes a base portion 21 forming a housing, a cover member 40, a paper supporter 30 as a first tray, and a discharge tray 50 as a second tray. The cover member 40 is provided so as to be able to cover the paper supporter 30. The paper supporter 30 is provided so as to be able to work as a feeding tray of the paper P. Furthermore, the discharge tray 50 is provided so as to place thereon the paper P having been read by the scanner 11.

When the cover member 40, as shown in FIG. 1, is closed, the upside of the base portion 21, the cover member 40, and the discharge tray 50 are arranged so as to form a moderately curved plane, or a continuous surface. This arrangement provides a beautiful appearance. The position of the discharge tray 50 taken in this situation is called a "no-operation position (E1)" of the discharge tray 50.

The "no-operation position (E1)" of the discharge tray 50 is a position in which the discharge tray 50 is spaced apart from a feeding path Q working as a path through which the paper P is fed, and does not function as a discharge tray. More specifically, this position is a position that is taken when the feeder unit 20 is out of use and forms the curved plane, i.e., forming a continuous surface, when the cover member 40 is closed.

With the cover member 40 being closed, a feeding opening 33 (see FIG. 2) later described is closed. A discharge opening 53 (see FIG. 2) is also closed.

The feeding opening 33 is an opening through which the paper P is inserted and set on a guide frame 22 later explained and a paper support 30. On the other hand, the discharge opening 53 is an opening through which the paper P is discharged to the discharge tray 50 which is described later.

A cutout portion 43 (see FIG. 1) is provided on one end side 42 of the cover member 40 located on the basis of a cover axis 41 of the cover member 40 (see FIGS. 3 to 6). Accordingly, a user can swing the cover member 40 from the closed position shown in FIG. 1 to the open position shown in FIG. 2 by using a finger to the cutout portion 43.

When the cover member 40 is opened, the paper supporter 30 and the feeding opening 33, both of which have been covered by the cover member 40, appear and at the same time the paper supporter 30 is displaced upward. This displaced position is called an "operation position (D2)" of the paper supporter 30.

The "operation position (D2)" of the paper supporter 30 is a position which the paper supporter 30 takes during use of the feeder unit 20. More specifically, it is a position taken when the cover member 40 is open.

A projecting strip 45 is provided on the other end side 44 of the cover member 40, which is located opposite to the one end side 42 of the cover member 40, to work as both a first and second power transmitters 70, 80; it pushes up to displace the paper supporter 30 to "the operation position (D2)". A detailed description about this will be given later.

The first power transmitter 70 is a transmitter unit which transmits power for opening or closing the cover member 40 to the paper supporter 30 so as to displace the paper supporter 30. Furthermore, the second power transmitter 80 is a transmitter unit which transmits power for opening or closing the cover member 40 to the discharge tray 50 so as to displace the discharge tray 50.

Edge guides 32, movable in a width direction X of the paper P, are provided on the paper supporter 30. The edge guides 32 are configured so as to at least partially project upward outside of the base portion 21 when the paper supporter 30 is in the "operation position (D2)". Accordingly, a user is easily able to stabilize the position and posture of the paper P by handling the edge guides 32 in setting the paper P on the paper supporter 30.

In the base portion 21, the guide frame 22 is provided; the paper P is set on a region ranging from the guide frame 22 to the paper supporter 30. Furthermore, the cover member 40 may be configured so as to allow the paper P to be supported by the inner side of the cover member 40.

Moreover, the cover member 40 is configured so as to displace the discharge tray 50 to a "operation position (E2)" when being opened. The discharge opening 53 is so configured to open following the displacement of the discharge tray 50.

The "operation position (E2)" of the discharge tray 50 is a position at which the discharge tray 50 forms a continuous surface with the feeding path Q so as to receive and place the discharged paper P thereon. In the embodiment, the "operation position (E2)" of the discharge tray 50 is lower than the "non-operation position (E1)" in the vertical plate arrangement direction (opposite to the arrow direction of a Z axis). The discharge tray 50 is configured so as to displace downward in the vertical plate arrangement direction to make contact with the other end of the feeding path Q and whereby forms a continuous surface with the feeding path Q.

The paper supporter 30 in the "operation position (D2)" and the discharge tray 50 in the "operation position (E2)" are configured so as to form a vertical plate arrangement structure.

The vertical plate arrangement structure is a structure which is constituted of different plate elements on different levels in the direction of the structure (z axis direction). The paper supporter 30 in the "operation position (D2)" and the discharge tray 50 in the "operation position (E2)" are not necessarily required to overlap with each other in the structure. They only have to be on different levels from each other in the vertical plate arrangement direction.

In the embodiment, the paper supporter 30 in the "operation position (D2)" is configured so as to be above the discharge tray 50 in the "operation position (E2)" in the vertical plate arrangement direction. The feeding path Q is formed in a U-shape viewed from the side.

How the paper supporter 30 and the discharge tray 50 are displaced by the opening or closing operation of the cover member 40 will be described below in detail.

Figure 3:
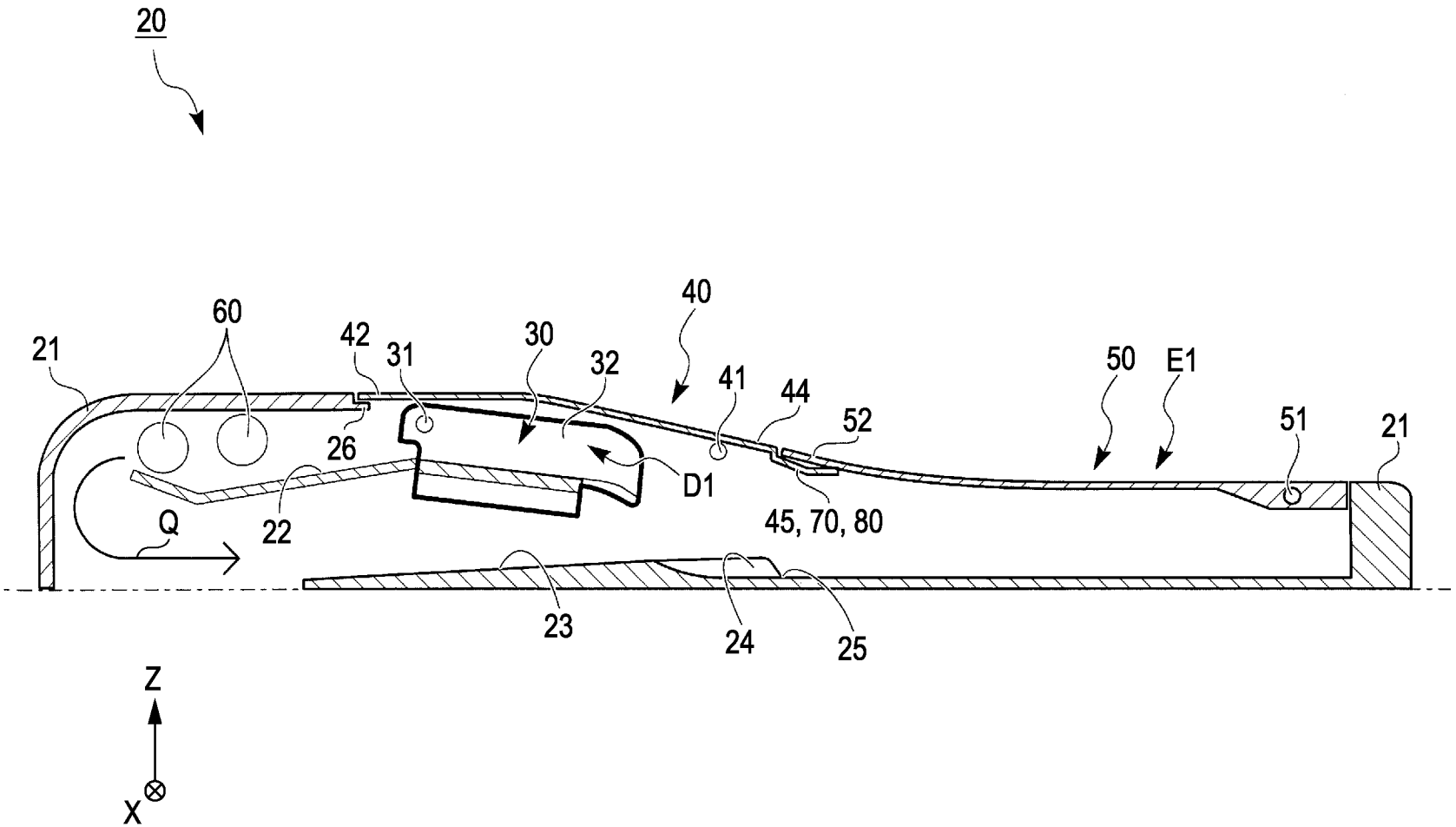
FIG. 3 is a sectional side view showing a feeder unit with a cover member closed according to the invention.
Figure 4:
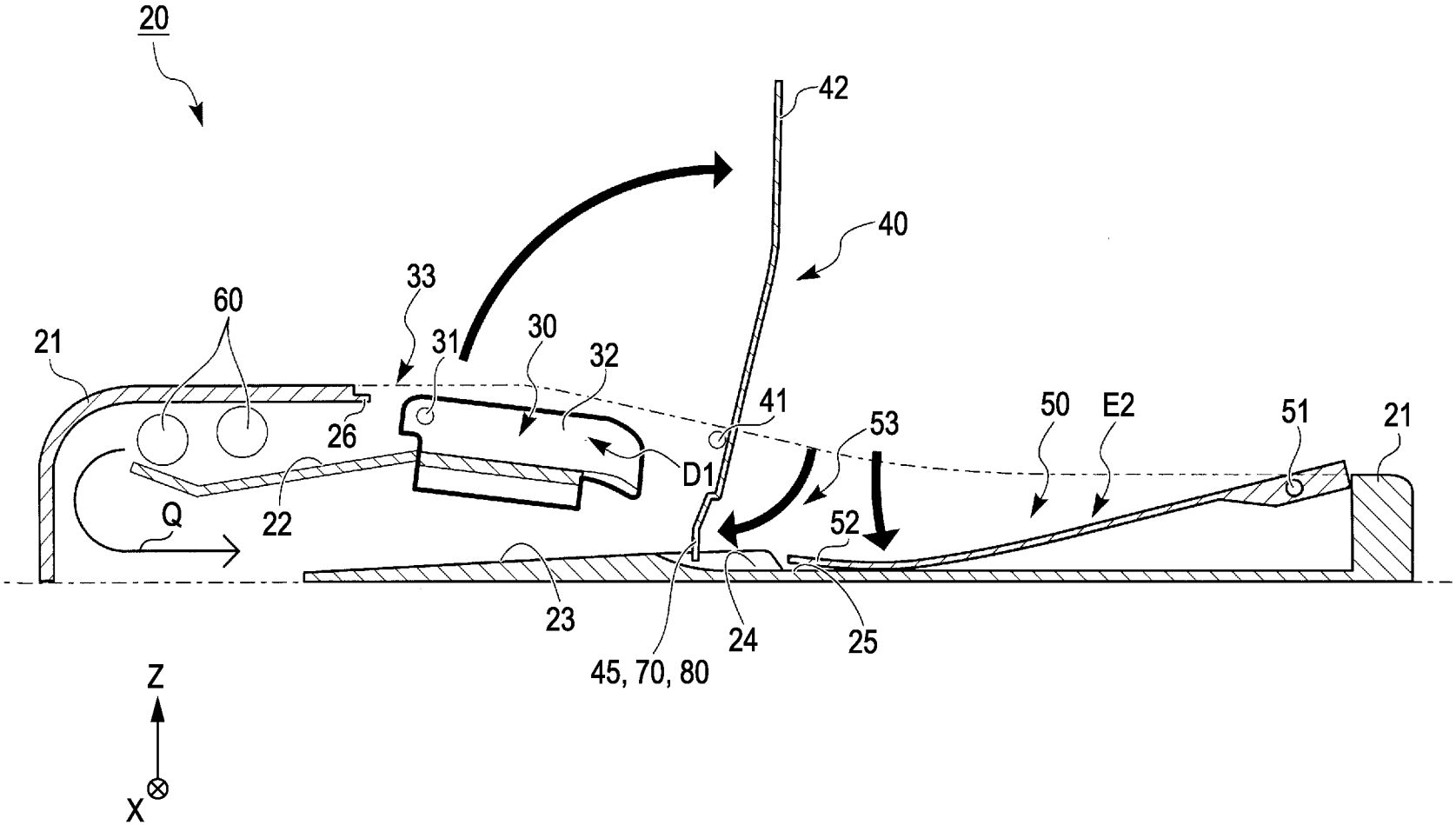
FIG. 4 is a sectional side view showing the feeder unit with the cover member in a half-way of opening/closing according to the invention.
Figure 5:
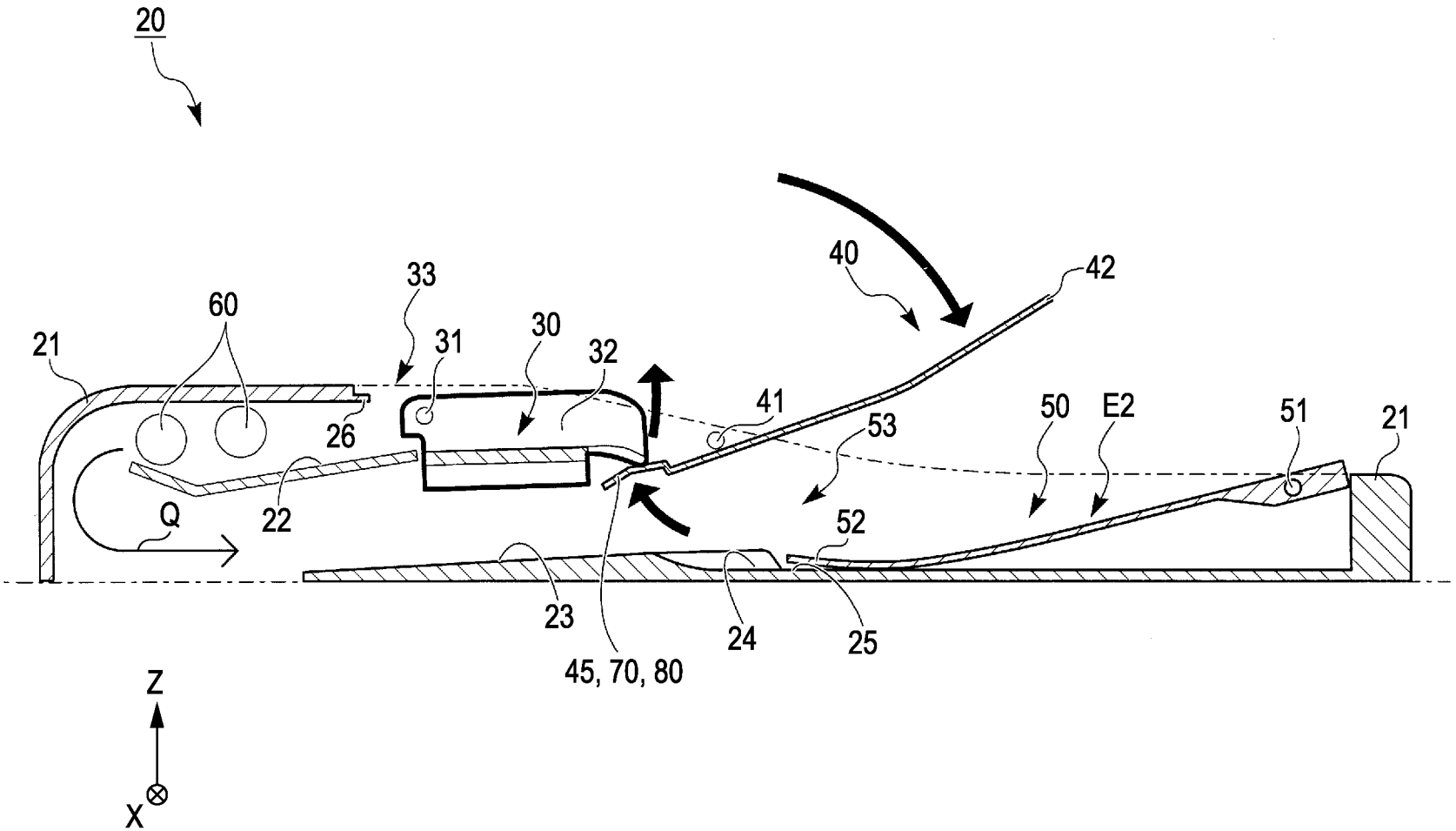
FIG. 5 is a sectional side view showing the feeder unit with the cover member in a half-way of opening/closing according to the invention.
Figure 6:
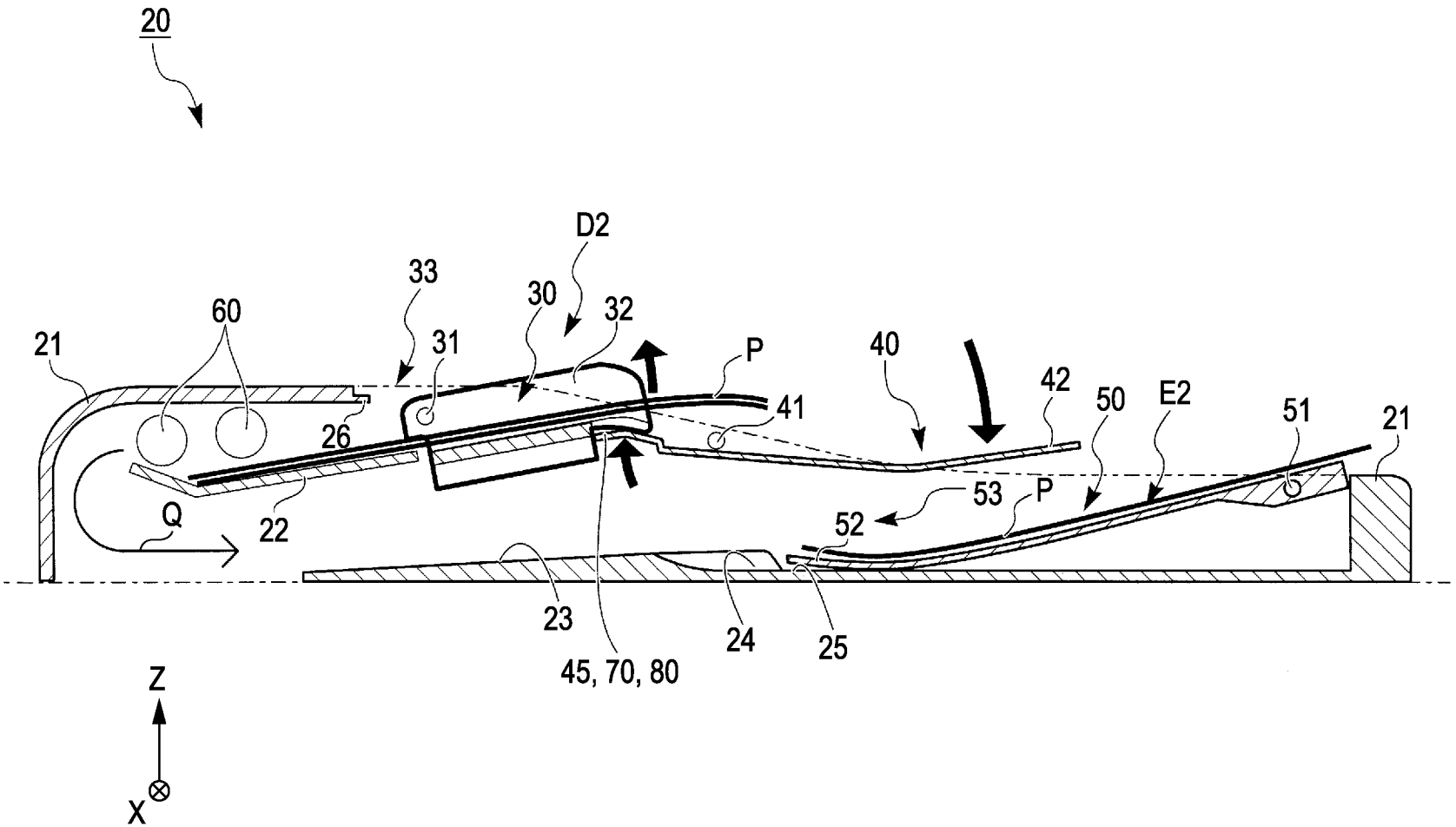
FIG. 6 is a sectional side view showing the feeder unit with the cover member opened according to the invention.

FIG. 3 is a sectional side view of the feeder unit with the cover member closed according to the invention. FIG. 4 is a sectional side view of the feeder unit with the cover member in a half-way of opening/closing according to the invention. Furthermore, FIG. 5 is a sectional side view showing the feeder unit with the cover member in the process of opening further swung in the opening direction from the state shown in FIG. 4. FIG. 6 is a sectional side view showing the feeder unit with the cover member opened according to the invention.

As shown in FIG. 3, the upper surface of the base portion 21, the cover member 40 and the discharge tray 50 form a mildly curved plane, i.e., a continuous surface when the cover member 40 is close as described above. The cover member 40 is provided so as to be swingable about a cover member axis 41 serving as the fulcrum of the cover member 40. The one end side 42 of the cover member 40 located based on the cover member axis 41 is contacted and stopped at a restriction portion 26 formed in the base portion 21. This mechanism restricts the counterclockwise swing of the cover member 40 as shown in FIG. 3, thereby making it possible to precisely determine the posture of the cover member 40 in the closed-state.

The discharge tray 50 is provided so as to be swingable about a discharge tray axis 51 serving as the fulcrum of the discharge tray 50. A free end 52 of the discharge tray 50 is configured so as to be supported by the projecting strip 45 formed on the other end side 44 opposite to the one end side 42 of the cover member 40. Accordingly, the "non-operation position (E1)" of the discharge tray 50 can be determined with high accuracy.

Furthermore, the paper supporter 30 is provided so as to be swingable about a supporter swing axis 31 serving as the fulcrum of the paper supporter 30.

The paper supporter 30 in FIG. 3 attempts to swing clockwise due to its own weight, but is restricted to the posture shown in FIG. 3 by a first swing restricting projection (not shown) provided in the base portion 21. The position at which the restricted posture is made is a "storage position (D1)" of the paper supporter 30.

The "storage position (D1)" of the paper supporter 30 is a position in which the paper supporter 30 is stored within the base portion 21. Specifically, this position is taken by the paper supporter 30 when the cover member 40 is closed.

Inside the feeder unit 20, the U-shaped feeding path Q is formed of the guide frame 22 and a fixed tray 23 which are arranged in the base portion 21. Then, the paper supporter 30 is disposed on the upstream side of the feeding path Q in the feeding direction of the paper P. On the other hand, the discharge tray 50 is disposed on the downstream side of the feeding path Q in the feeding direction of the paper P.

A recess 24 and a step portion 25 are furthermore formed on the downstream side of the fixed tray 23 in the feeding direction of the paper P. The detailed description of the above-mentioned elements will be given below.

The recess 24 is provided so as to allow the projecting strip 45 of the cover member 40 to pass therethrough in its swinging movement. The step portion 25 is configured so that the free end 52 of the discharge tray 50 comes down to a lower place of the step portion 25 when the discharge tray 50 displaces to the "operation position (E2)" as described later (see FIGS. 4 to 6), thus making it possible to guide smoothly the paper P to the discharge tray 50.

Feeding rollers 60 are configured so as to be able to pick up and feed sheet by sheet the paper P set across the guide frame 22 and the paper supporter 30.

As shown in FIG. 4, a user swings the cover member 40 clockwise, i.e., in the direction to which the cover member 40 is opened, by using a finger to the cutout portion 43 prepared on the one end side 42 of the cover member 40 (see FIG. 1). At this time, the discharge tray 50 is displaced from the "non-operation position (E1)" to the "operation position (E2)".

More specifically, the free end 52 of the discharge tray 50 swings counterclockwise due to its own weight while supported by the projecting strip 45 of the cover member 40 being swung clockwise. The free end 52 of the discharge tray 50 is then contacted and stopped at the lower place of the step portion 25 in the base portion 21. As the cover member 40 is further swung clockwise, the projecting strip 45 is consequently spaced apart from the free end 52 of the discharge tray 50 and enters the recess 24. As a result, the feeding opening 33 appears and at the same time the discharge opening 53 is caused to be open.

As shown in FIG. 5, the projecting strip 45 approaches the paper supporter 30 as a user further swings the cover member 40 clockwise from the position shown in FIG. 4. By further swinging the cover member 40 clockwise, the projecting strip 45 comes to abut the paper supporter 30 then pushes up vertically the paper supporter 30. Specifically, the paper supporter 30 can be swung counterclockwise, as shown in FIG. 5, about the supporter swing axis 31 serving as a fulcrum.

As shown in FIG. 6, the paper supporter 30 is further swung counterclockwise as a user further swings the cover member 40 from the position shown in FIG. 5. Thus, the paper supporter 30 can be displaced to the "operation position (D2)" of the paper supporter 30 at which the edge guides 32 are at least partially projected upward from the base portion 21.

The paper supporter 30 is configured so as to be restricted from being swung counterclockwise beyond the "operation position (D2)" by a second swing restricting projection (not shown) prepared in the base portion 21.

The paper supporter 30 is also configured so as to be stabilized in the "operation position (D2)" by a stabilizer (not shown).

For example, a small projection and a small recess may be provided to configure a stabilizer, in which the small projection is prepared on any one of the cover member 40 and the base portion 21, and the small recess is prepared on the other one of the cover member 40 and the base portion 21. Then, the small projection and the small recess can be engaged with each other so as to stabilize the paper supporter 30 to the "operation position (D2)".

Note that the sustaining force of the stabilizer is strong enough to hold the weight of the paper supporter 30 and the weight of the paper P to be set.

A user checks the positions of the edge guides 32 after the paper P is set on the guide frame 22 and the paper supporter 30, and operates a display device (not shown) to let the information recorded on the paper P be read by a scanner 11. Thereafter, the feeding rollers 60 pick up and feed the uppermost sheet of the paper P onto the downstream side in the feeding direction. The paper P to be fed is then turned over at the U-shape portion along the feeding path Q. The information recorded on the paper P is read by the scanner 11 during this feeding operation.

Then, the paper P is further fed by rollers (not shown) onto the downstream side in the feeding direction, and is discharged through the fixed tray 23 to the discharge tray 50. At the time when the reading of a foregoing sheet of the paper P by the scanner 11 is completed, a subsequent sheet of the paper P is picked up by the feeding rollers 60 and is read by the scanner 11 in the same manner as in the case of the foregoing sheet of the paper P. In this way, feeding, reading and discharging operations are sequentially performed. As the number of sheets of the paper P set on the paper supporter 30 decreases, the number of sheets of the paper P set on the discharge tray 50 increases; the scanning comes to an end when the last sheet of the paper P is discharged to the discharge tray 50.

The closing operation of the cover member 40 being open will be described below.

A user swings the cover member 40 counterclockwise, i.e., in the closing direction, from the position shown in FIG. 6. Then, the projecting strip 45 is swung counterclockwise, causing the paper supporter 30 to be swung clockwise due to its own weight while being supported by the projecting strip 45, and resulting in the state shown in FIG. 5.

As the user further swings the cover member 40 counterclockwise from the state shown in FIG. 5, the paper supporter 30 is further swung clockwise due to its own weight while being supported by the projecting strip 45. Then, the paper supporter 30 abuts the first swing restricting projection (not shown) described above and finally stops, i.e., stops at the "storage position (D1)" of the paper supporter 30.

As the user further swings the cover member 40 counterclockwise, the projecting strip 45 is then spaced apart from the paper supporter 30 and enters the recess 24 of the base portion 21, resulting in the state shown in FIG. 4.

As the user further swings the cover member 40 counterclockwise from the position shown in FIG. 4, the projecting strip 45 comes to a position between the lower place of the step portion 25 in the base portion 21 and the free end side 52 of the discharge tray 50. Subsequently, the projecting strip 45 picks up the free end side 52 of the discharge tray 50 to swing the discharge tray 50 clockwise. The cover member 40 is put on the completely closed position when the one end side 42 of the cover member 40 makes contact with restriction portion 26 of the base portion 21, and the discharge tray 50 is displaced to the "non-operation position (E1)" and stops the swinging. At the same time, the feeding opening 33 is blocked by the cover member 40. The discharge opening 53 is also closed.

As described above, the paper supporter 30 and the discharge tray 50 are displaced in accordance with each other through opening or closing operation of the cover member 40. The paper supporter 30 can be displaced from the "storage position (D1)" to the "operation position (D2)" by swinging the cover member 40 from the closed-state to the open-state.

The distance between the paper supporter 30 and the fixed tray 23 is increased at this time. That is, the space for the feeding path Q in the thickness direction of the paper P (Z axis direction in the embodiment) is configured so as to be large enough when the feeder unit 20 is in use, and in contrast to be as small as possible when not in use. A useless space can consequently be eliminated when the cover member 40 is closed, i.e., when the feeder unit 20 is not in use. This elimination of the useless space contributes to miniaturization of the whole of the feeder unit.

More specifically, the thickness of the whole of the feeder unit can be reduced in the Z axis direction when the cover member 40 is closed as compared to the configuration in which the paper supporter 30 is fixed at the "operation position (D2)".

In addition, the user can easily remove a jammed sheet of the paper P by swinging up the paper supporter 30 when the paper P is jammed beneath the paper supporter 30, since the paper supporter 30 is swingably provided. This means that a paper jamming problem can easily be solved.

In the embodiment described above, the description is made on conditions that the first tray is the paper supporter 30 disposed at a vertically upper (in the arrow direction of the Z axis) position on the upstream side in the feeding direction, and the second tray is the discharge tray 50 disposed at a vertically lower position on the downstream side in the feeding direction. However, a reversed positional relationship may be possible. Specifically, on conditions that the first tray is the discharge tray 50 and the second tray is the paper supporter 30, a configuration in which the paper P is fed from the first tray (the discharge tray) located at a vertically lower position to the second tray (the paper supporter) located at a vertically upper position, may be possible.

In the embodiment described above, the projecting strip 45 is configured so as to work as both the first and second power transmitters 70, 80. Alternatively, the first and second power transmitters may be provided separately.

The projecting strip 45 is also configured so as to directly act on the paper supporter 30 and the discharge tray 50; it may alternatively be configured so as to perform an indirect action thereto via other members.

In the embodiment described above, the cover member 40 is configured so as to be swung; it may of course alternatively be configured so as to be slid in opening or closing operation.

In the embodiment described above, the "operation position (E2)" of the discharge tray 50 is located further inside of the base portion 21 compared to the "non-operation position (E1)". Alternatively, a reversed positional relationship may be possible. That is, the discharge tray 50 may be configured so as to displace to a position projecting upward from the base portion 21 as an operation position. Such a configuration further contributes to miniaturization of the whole of the feeder unit with the cover member 40 being closed at the non-operation position.

Note that the invention is not limited to the embodiments described above and various modifications can be made within the scope of the invention, and those modifications are also included in the scope of the invention.

The feeder unit 20 according to the embodiment of the invention includes: the base portion 21 forming a housing; the paper supporter 30 serving as a first tray which keeps the "storage position (D1)" in which the paper supporter 30 is stored within the base portion and the "operation position (D2)" that is displaced in a direction to which the paper supporter 30 projects outside of the base portion from the "storage position (D1)", and is provided at one end of the feeding path Q of the paper P, which is one example of a medium, so as to place the paper P thereon; the cover member 40 which is openably and closeably provided so as to cover the paper supporter 30 positioned in the "storage position (D1)" when being closed and to uncover the paper supporter 30 when being open; and the projecting strip 45, one example of the first power transmitter 70, which transmits power to open or close the cover member 40 to the paper supporter 30. The projecting strip 45 is configured so that the paper supporter 30 is displaced to the "operation position (D2)" with the displacement of the cover member 40 when the cover member 40 is switched to the open-state, and that the paper supporter 30 is displaced to the "storage position (D1)" with the displacement of the cover member 40 when the cover member 40 is switched to the closed-state.

In the embodiment, the discharge tray 50 serving as a second tray to place the paper P thereon, which is provided at the other end of the feeding path Q, keeps the "operation position (E2)" shown in FIG. 6 and the "non-operation position (E1)" shown in FIG. 3.

The "operation position (E2)" is a position at which the discharge tray 50 forms a continuous surface with the feeding path Q, and can place the paper P thereon. The "non-operation position (E1)" is a position at which the discharge tray 50 is spaced apart from the feeding path Q and functions, for example, as an external surface as shown in FIG. 3.

Furthermore, the cover member 40 is provided with the projecting strip 45 which serves as the second power transmitter 80 which transmits power to open and close the cover member 40 to the discharge tray 50. The projecting strip 45 is configured so as to displace the discharge tray 50 to the "operation position (E2)" with the displacement of the cover member 40 when the cover member 40 is switched to the open-state, and to displace the discharge tray 50 to the "non-operation position (E1)" with the displacement of the cover member 40 when the cover member 40 is switched to the closed-state.

In the embodiment, the paper supporter 30 is furthermore provided with the edge guides 32 which are displaceable in the width direction X of the paper P to align the side edges of the paper P, and is configured so as to be displaced from the "non-operation position (D1)" to the "operation position (D2)", causing the edge guides 32 to project upward outside of the base portion 21.

In the embodiment, the cover member 40 is provided so as to be opened or closed by swinging itself. The one end side 42 of the cover member 40 located on the basis of the swinging fulcrum of the cover member 40 covers the paper supporter 30 when the cover member 40 is closed. The other end side 44 pushes up to displace the paper supporter 30 to the "operation position (D2)" when the cover member 40 is swung to be open.

In the embodiment, the discharge tray 50 is furthermore provided at the other end of the feeding path Q to serve as the second tray for placing the paper P thereon. The feeding path Q is formed in a U-shape based on the vertical plate arrangement structure, in which the paper supporter 30 places thereon the paper P before being fed and the discharge tray 50 places thereon the paper P after being fed. The paper supporter 30, which is located above the discharge tray 50 in the vertical plate arrangement direction (arrow direction of Z axis), is displaced to the "operation position (D2)" upward from the "non-operation position (D1)" in the vertical plate arrangement direction when the cover member 40 is switched to the open-state, whereby the gap in the Z axis direction, i.e., the paper P thickness direction, is increased in the feeding path Q located below the paper supporter 30 in the vertical plate arrangement direction.

What is claimed is:

1. A feeder unit comprising:

a base portion forming a housing;

a first tray that keeps a storage position in which the first tray is stored within the base portion and an operation position that is displaced in a direction to which the first tray projects from the storage position, and is provided at one end of a feeding path of a medium so as to place the medium thereon;

a second tray that keeps an operation position in which the second tray forms a continuous surface with the feeding path and is provided at the other end of the feeding path so as to place the medium thereon, and a non-operation position in which the second tray is spaced apart from the feeding path, and a cover member that is openably and closeably provided to cover a surface on which the medium is placed of the first tray in the storage position when being closed or uncover the surface on which the medium is placed of the first tray when being open, wherein the cover member and the second tray form a continuous surface when the second tray is in the non-operation position; and a power transmitter that transmits power to open and close the cover member to the first tray, wherein:

the power transmitter is configured so as to displace the first tray to the operation position with the displacement of the cover member when the cover member is switched to an open-state, and to the storage position with the displacement of the cover member when the cover member is switched to a closed-state, the power transmitter is configured so as to displace the second tray to the operation position with the displacement of the cover member when the cover member is switched to the open-state, and to the non-operation position with the displacement of the cover member when the cover member is switched to the closed-state, the power transmitter includes a projecting strip that comes to abut the first tray and that pushes against the first tray so as to displace the first tray to the operation position when the cover member is switched to the open-state, and a gap in a thickness direction of the medium is increased in the feeding path located below the first tray in a vertical plate arrangement direction when the first tray is displaced upward to the operation position when the cover member is switched to the open-state.

2. The feeder unit according to claim 1, wherein the first tray includes edge guides that may be displaced in a width direction of the medium to align side edges of the medium, the edge guides being projected upward outside of the base portion when the first tray is displaced from the storage position to the operation position.

3. The feeder unit according to claim 1, wherein the cover member is opened or closed by swinging itself, and one end side of the cover member located based on a swinging fulcrum of the cover member covers the first tray when the cover member is closed, and the other end side of the cover member pushes up to displace the first tray to the operation position when the cover member is swung to be open.

4. The feeder unit according to claim 1, wherein the feeding path is formed in a U-shape based on the vertical plate arrangement structure, in which the medium is placed on the first tray places before being fed and the medium is placed on the second tray places after being fed; and the first tray is located above the second tray in a vertical plate arrangement direction.

* * * * *